US008051506B2

(12) United States Patent
Segal

(10) Patent No.: US 8,051,506 B2
(45) Date of Patent: Nov. 8, 2011

(54) SHOWER STORAGE CABINET

(76) Inventor: Stanley H Segal, Boca Raton, FL (US)

( * ) Notice: Subject to any disclaimer, the term of this patent is extended or adjusted under 35 U.S.C. 154(b) by 757 days.

(21) Appl. No.: 12/129,239

(22) Filed: May 29, 2008

(65) Prior Publication Data

US 2008/0297018 A1 Dec. 4, 2008

Related U.S. Application Data

(60) Provisional application No. 60/940,490, filed on May 29, 2007.

(51) Int. Cl.
*A47K 3/30* (2006.01)

(52) U.S. Cl. ..... 4/597; 312/245; 312/351.1

(58) Field of Classification Search ..... 4/597, 549; 312/350, 351.1, 139.2, 242, 245
See application file for complete search history.

(56) References Cited

U.S. PATENT DOCUMENTS

| | | | | |
|---|---|---|---|---|
| 1,181,331 | A * | 5/1916 | Metzger | 312/139.2 |
| 2,463,238 | A * | 3/1949 | Bissell, Jr. et al. | 49/408 |
| 2,628,877 | A * | 2/1953 | Woo | 312/128 |
| 2,784,302 | A * | 3/1957 | Golden | 362/133 |
| 2,821,451 | A * | 1/1958 | Kaufman | 312/139.2 |
| 3,485,545 | A * | 12/1969 | Newman et al. | 312/258 |
| 3,864,760 | A * | 2/1975 | Bowen | 4/597 |
| 5,079,872 | A * | 1/1992 | Short | 49/409 |
| 7,096,519 | B2 * | 8/2006 | Ferreri et al. | 4/596 |
| 2005/0127265 | A1 * | 6/2005 | Giovinazzi | 248/673 |

* cited by examiner

*Primary Examiner* — David Purol
(74) *Attorney, Agent, or Firm* — David W. Barman

(57) ABSTRACT

The present invention is an article for storing shower and bathroom supplies comprising a rectangular unit with at least one cavity positioned between the center line of the bottom portion of the article and each terminal end of said bottom portion and a mounting whereby said mounting secures the article into place above a shower header.

2 Claims, 4 Drawing Sheets

SHOWER STORAGE CABINET

INDEX TO RELATED APPLICATION

This application claims the benefit of U.S. Provisional Patent No. 60/940,490, filed May 29, 2007, the disclosure of which is incorporated herein by reference in its entirety.

BACKGROUND OF THE INVENTION

The modern bathroom is replete with articles and devices provided for convenience.

The bathroom further is a placed where numerous personal care items are typically stored. There are many devices that provide storage in, or near, the shower area. However, the storage capacity of these articles is usually limited. The present invention has addressed the limitation of storage available in, or near, the shower area of the bathroom.

BRIEF SUMMARY OF THE INVENTION

Many showers have glass or other solid doors that border the open area of the shower. The doors are typically slid open and closed, which helps contain the water in the shower area. Most often these doors do not extend all the way up to the ceiling of the bathroom. There is typically anywhere from six inches and upward from the top of the upper shower door track (commonly called the header) and the ceiling of the bathroom.

The header typically is rectangular and encompasses three contiguous planer sides. Most commonly, two of those sides extend downward vertically from a horizontal side. The downward extending sides have a planer surface that extends below the track used to move shower doors.

The present invention has come up with a novel way of utilizing the space between the shower header and the ceiling for the storage of personal care items.

In one embodiment the present invention is an article for storing shower and bathroom supplies comprising:

a. a rectangular bottom portion with at least one cavity positioned between the center line and each terminal end of said bottom portion;
b. at least one slot along each longitudinal side of said bottom portion, suitable for holding a door, and allowing said door to slidably move longitudinally along said slot;
c. at least one door placed within said slot, said door configured such that it may be slidably moved;
d. a ceiling portion with at least one slot on each longitudinal side for accommodating said sliding door;
e. at least two walls wherein each of said walls is placed perpendicular to said rectangular bottom portion, and positioned between said rectangular bottom portion and ceiling portion.

The present invention has discovered a unique configuration for a storage article whereby said article may be mounted above a conventional shower header.

In one embodiment, the mounting comprises a J-hook to secure the article to the shower header. The J-hook of the present invention is an elongated rod with a curve at one end, resembling the shape of the letter "J". As described above, the shower header has two vertical portions that are substantially planer and extend downward from the horizontal portion of the shower header. The extension typically extends past the track portion contained within the header. The J-hook is positioned such that the "J" portion of the hook contacts the lower outer edge of the vertical downward portions of a conventional shower header. The straight end of the J-hook passes through a cavity in the bottom portion of the article. The J-hook may then be secured into place by any suitable means.

One preferred embodiment provides for a collar ring with a set screw, whereby the J-hook may be tightened into place. Preferably, at least four J-hooks are used to secure the article into position. Mounting in this manner is advantageous because there is no need to drill or otherwise disturb the structural integrity of the shower header.

In an alternative embodiment, the J-hook may be permanently attached to a spring and stopper device, whereby the hook is passed through the bottom portion of the article and once the J-hook is in position on the underside of the shower header, the tension from the screw urges the J-hook upwards and secures the article into position.

An alternative embodiment, provides for mounting into each of the shower walls whereby the article is held is place through mountings attaching to either or both of two walls on either end or on the underside of the ceiling portion.

The article may be constructed of any suitable material. Suitable materials may include but not be limited to, wood, wood composites, plastics, plastic composites, carbon composites, metal, metal composites, metal alloys, and combinations thereof.

DETAILED DESCRIPTION OF THE PREFERRED EMBODIMENTS

Figure 1:
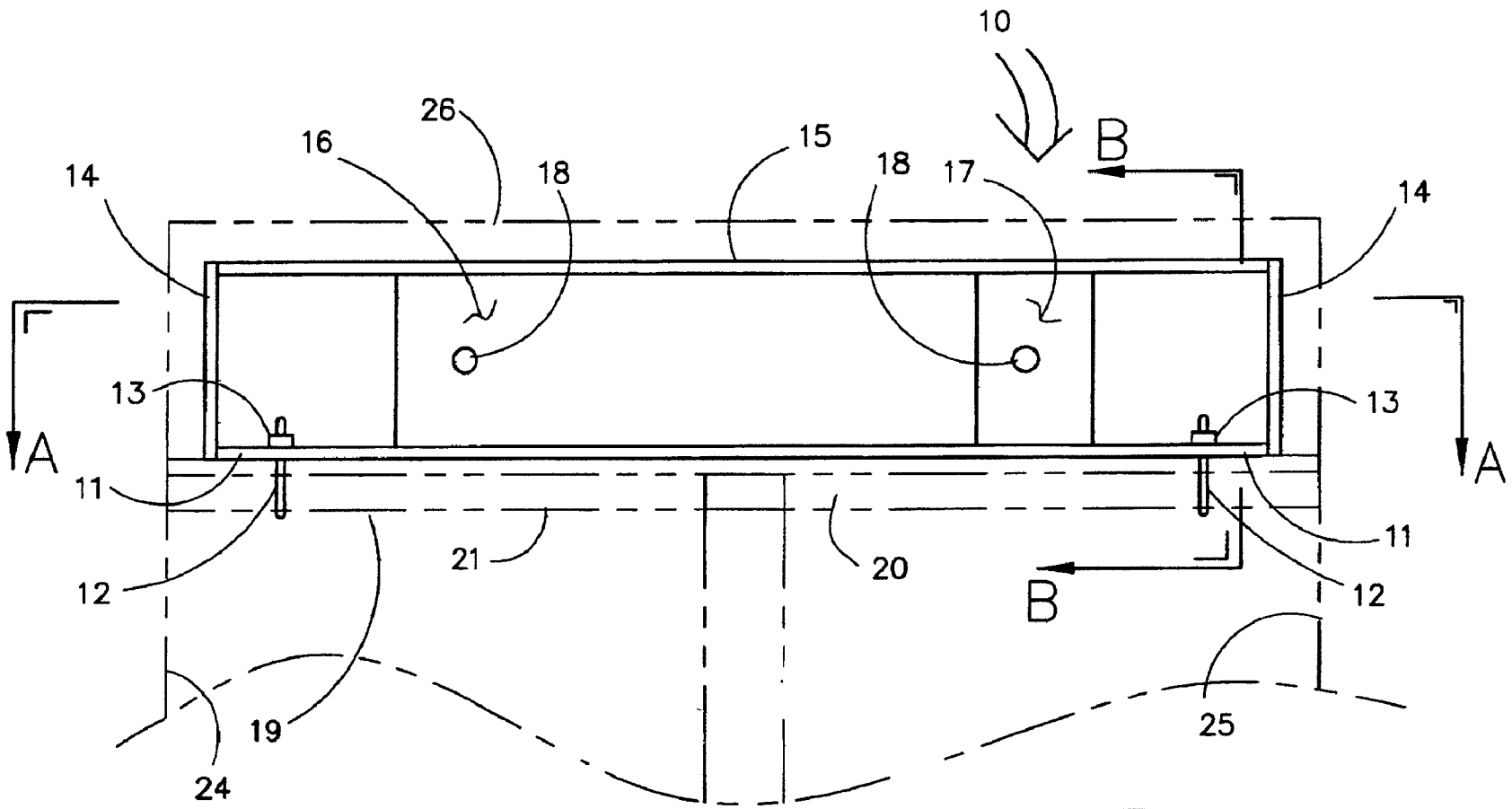
FIG. 1 is a side view showing the article of the present invention.

Article 10 has bottom portion 11, sidewalls 14, and ceiling portion 15. Along each longitudinal side of article 10 are doors 16 and 17 that slidably move along door track 28 and 29. Article 10 is placed on the top of shower header 19 between first shower wall 24 and second wall 25. Article 10 is configured to fit within the vertical opening, between the top of shower header 19, and the shower ceiling 26. J-hook 12 is inserted through a bottom portion cavity 27 in bottom portion 11 and J-hook 12 extends along the sidewall 20 of shower header 19 below lower edge 21 of shower header 19 and hooks inside side wall 20 by wrapping around lower edge 21. J-hook 12 is secured into position by a locking screw on collar ring 13. Bottom portion 11 comprises outer door track 28 and inner door track 29 that receive doors 16 and 17 that may be slidably moved to open and close the access to the interior or article 10.

Figure 2:
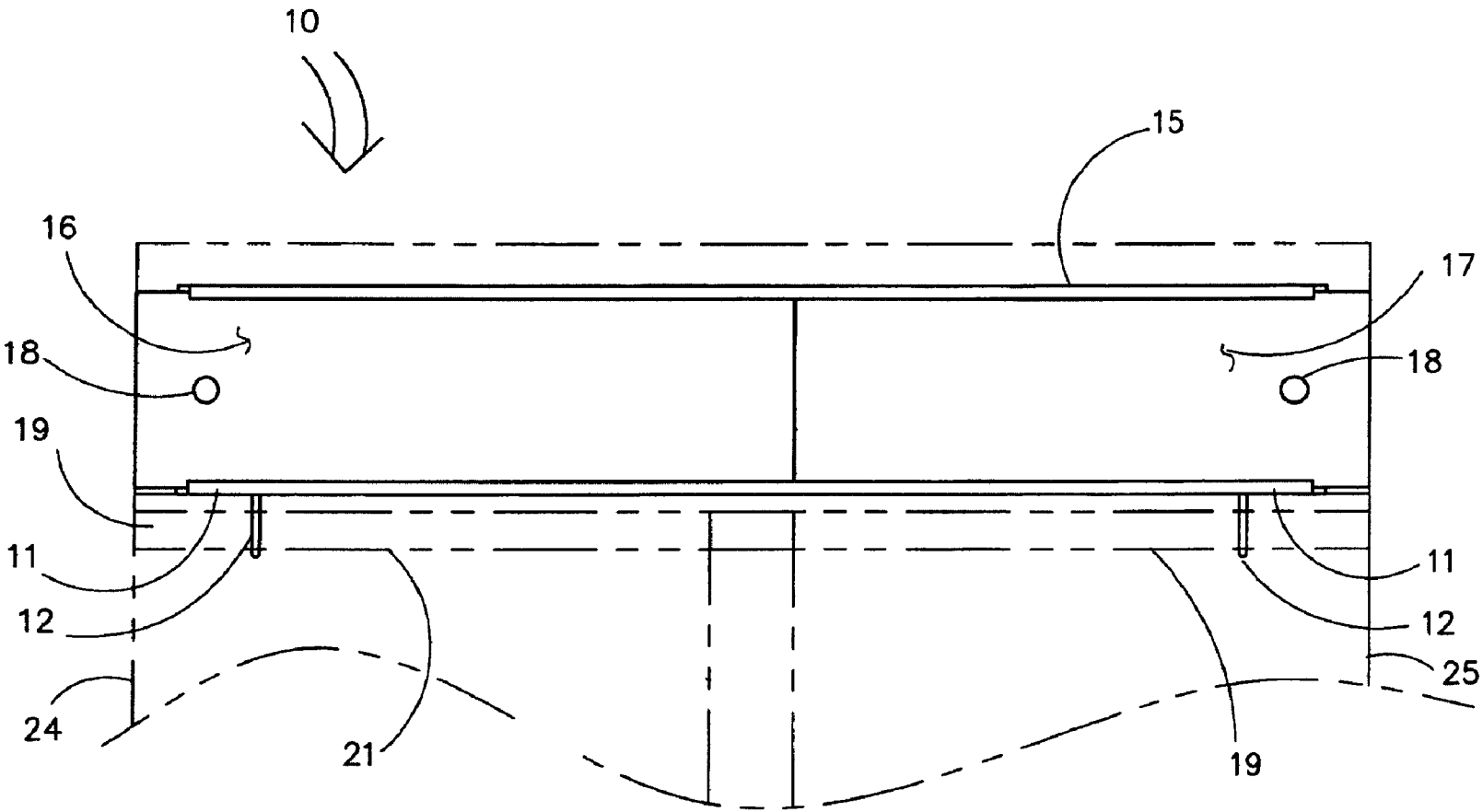
FIG. 2 is a side view showing the article of the present invention, whereby the doors on the outer portion can be seen extending the entire length of the shower opening.
Figure 3:
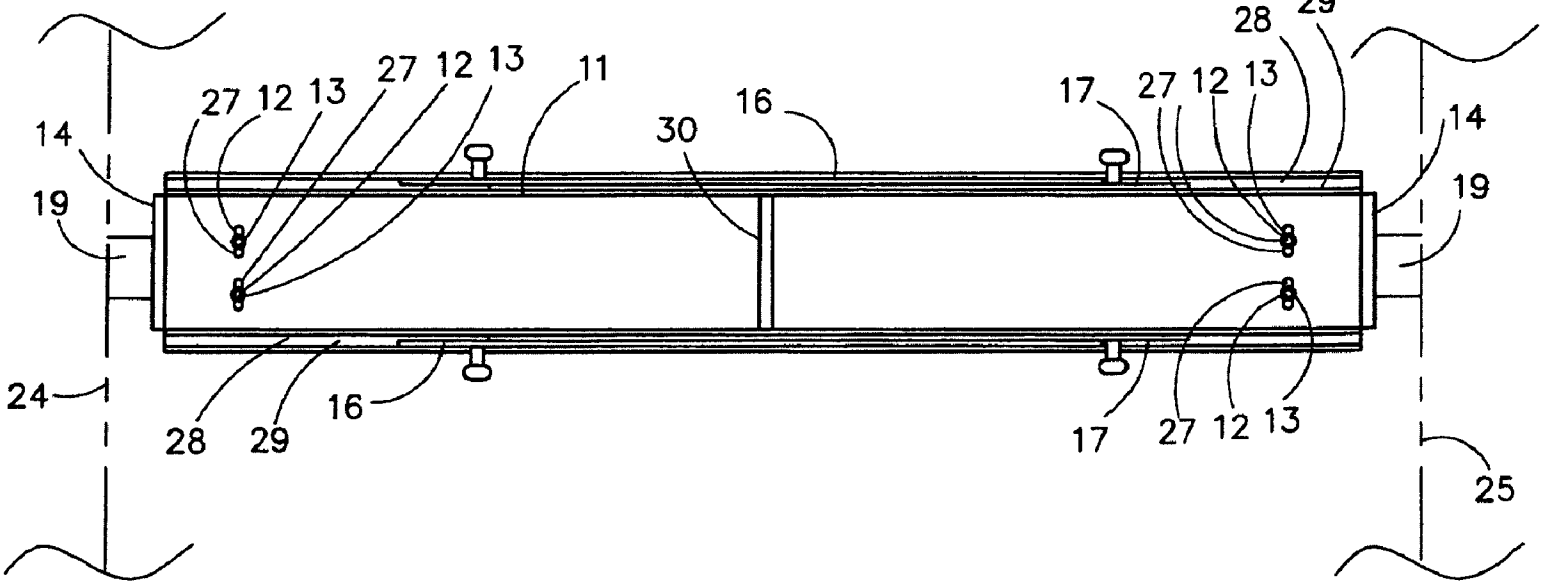
FIG. 3 is a top cross-section view through lines 8A of FIG. 1 and FIG. 2.
Figure 4:
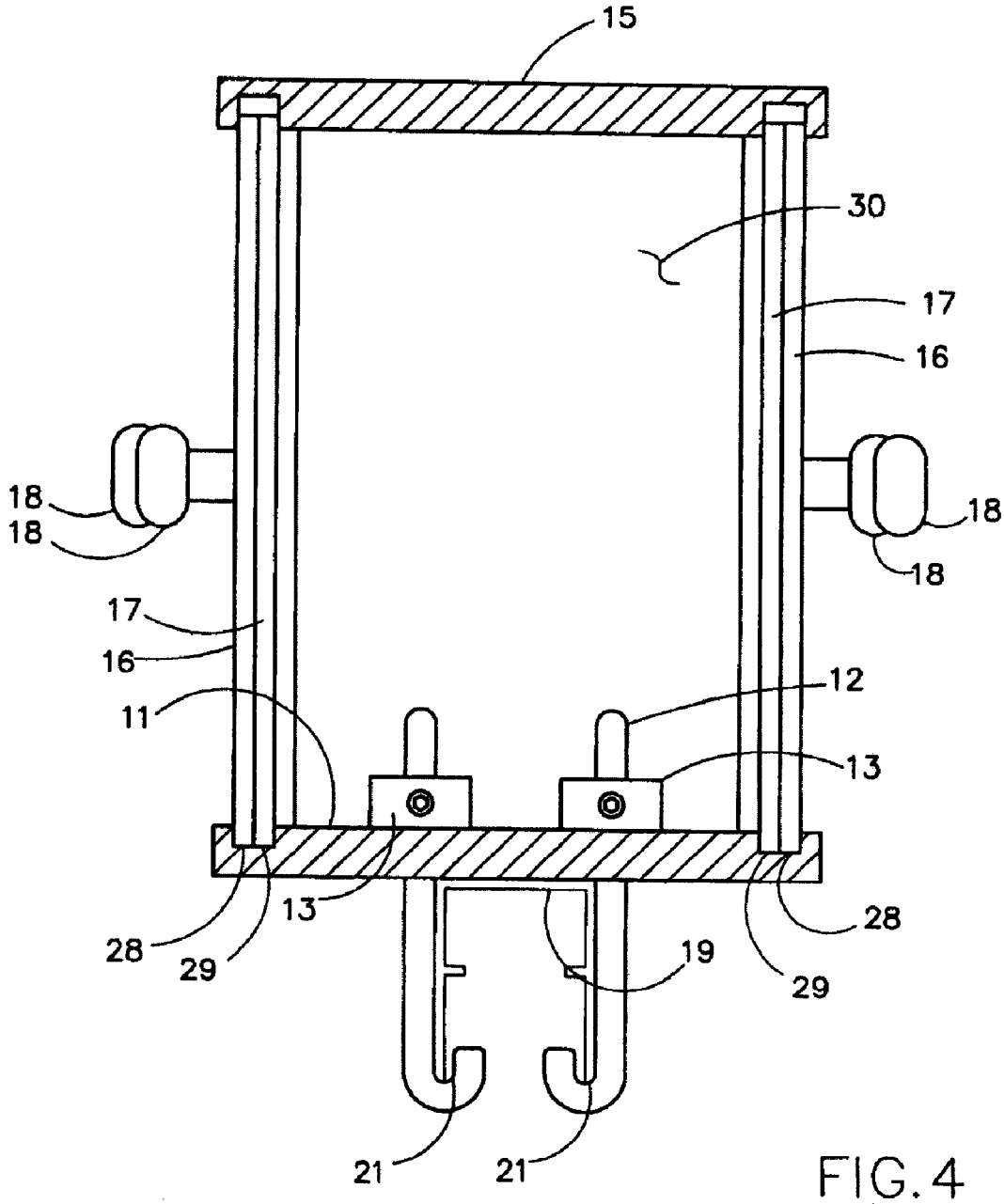
FIG. 4 is a cross section along lines B-B of FIG. 1.

Article 10 comprises identically configured bottom portion 11 and ceiling portion 15. A user will attach at least two walls 14 perpendicularly to bottom portion 11. After attachment of two walls 14, the ceiling portion 15 is attached to the walls 14. Doors 16 and 17 are positioned into inner door track 29 and outer door track 28, which are along each the longitudinal side of bottom portion 11 and ceiling portion 15. Article 10 is configured such that bottom portion 11 and ceiling portion 15 fits within most shower openings. Because shower openings are not standardized, it is anticipated there will be a gap on either end of the article between bottom portion 11, and first shower wall 24, and second shower wall 25. The present invention considers the aesthetics of this gap and provides doors 16 and 17 may extend pass the boundary of bottom portion 11 and ceiling portion 15 such that the gap may be concealed (See generally FIG. 2 and FIG. 3).

Article 10 is then raised into position above shower header 19. J-hook 12 is passed through cavity 27 in bottom portion 11 and the "J" portion of the J-hook 12 is permitted to contact lower edge 21 of sidewall 20 of a shower header. Once the contact has completed, the user will place a collar ring 13 with set screw in position such that the collar ring 13 is in contact with the upper surface of the bottom portion 11. Collar ring 13 is then tightened using a set screw and the tightening of the set screw secures article 10 into a fixed position. This process is repeated for each of four J-hook assemblies.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An article for storing shower and bathroom supplies comprising:

a. a rectangular bottom portion with at least one cavity positioned between a center line and each terminal end of said bottom portion;

b. at least one slot along each longitudinal side of said bottom portion suitable for holding a door and allowing said door to slidably move longitudinally along said slot;

c. at least one door placed within said slot and configured such that it may be slidably moved;

d. a ceiling portion with at least one slot on each longitudinal side for accommodating said sliding door;

e. a mounting that secures the article on a header of a shower door; wherein said mounting comprises a J-hook inserted through a bottom portion of said cavity such that it contacts a lower edge portion of said header and said J-hook is secured into position by a collar ring that has incorporated into said ring a set screw.

2. The article of claim 1 wherein said door slidably moves longitudinally along said slot and contacts a shower wall near an article sidewall.

* * * * *